US006695036B2

(12) United States Patent
Brandl et al.

(10) Patent No.: US 6,695,036 B2
(45) Date of Patent: Feb. 24, 2004

(54) METHOD FOR PRODUCING A CAST PART, MODEL MOLD, AND CERAMIC INSERT FOR USE IN THIS METHOD

(75) Inventors: Herbert Brandl, Waldshut-Tiengen (DE); Alexander Hoffs, West Palm Beach, FL (US); Roland Muecke, Windisch (CH); Sergej Riazantsev, Moscow (RU); Alexander Beeck, Orlando, FL (US)

(73) Assignee: Alstom (Switzerland) Ltd, Baden (CH)

( * ) Notice: Subject to any disclaimer, the term of this patent is extended or adjusted under 35 U.S.C. 154(b) by 4 days.

(21) Appl. No.: 09/991,991

(22) Filed: Nov. 26, 2001

(65) Prior Publication Data

US 2002/0129924 A1 Sep. 19, 2002

(30) Foreign Application Priority Data

Dec. 4, 2000 (DE) ..... 100 60 141

(51) Int. Cl.[7] ..... B22C 9/04; B22C 9/10
(52) U.S. Cl. ..... 164/516; 164/122.1; 164/369
(58) Field of Search ..... 164/516, 122.1, 164/122.2, 369

(56) References Cited

U.S. PATENT DOCUMENTS

| | | | | |
|---|---|---|---|---|
| 3,690,367 A | | 9/1972 | Daniels | |
| 3,763,926 A | | 10/1973 | Tschinkel et al. | |
| 5,291,654 A | * | 3/1994 | Judd et al. | 29/899.721 |
| 5,296,308 A | | 3/1994 | Caccavale et al. | |
| 5,460,776 A | | 10/1995 | Ackermann et al. | |
| 6,413,650 B1 | * | 7/2002 | Dupree et al. | 428/579 |

FOREIGN PATENT DOCUMENTS

| | | |
|---|---|---|
| DE | 40 41 330 C2 | 7/1992 |
| DE | 196 36 968 A1 | 3/1998 |
| EP | 0 749 790 A1 | 12/1996 |

* cited by examiner

*Primary Examiner*—Kuang Y. Lin
(74) *Attorney, Agent, or Firm*—Burns, Doane, Swecker & Mathis, L.L.P.

(57) ABSTRACT

The invention relates to a method for producing a cast part of a thermal turbo-machine by way of a known casting process. Between a model mold and a ceramic insert, projections are located on the ceramic insert, whereby the projections have an angle (α, β) between the center line and the outer edge of the projections of less than 30°, and whereby the projections are used both for the fixation of the insert during the casting process and for the reduction of the notch factor inside the recesses created in the cast part.

11 Claims, 2 Drawing Sheets

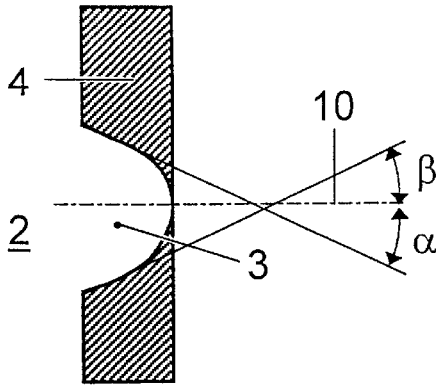
Fig. 3a
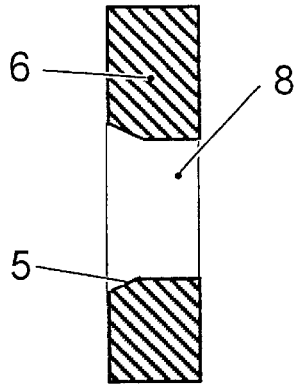
Fig. 4a
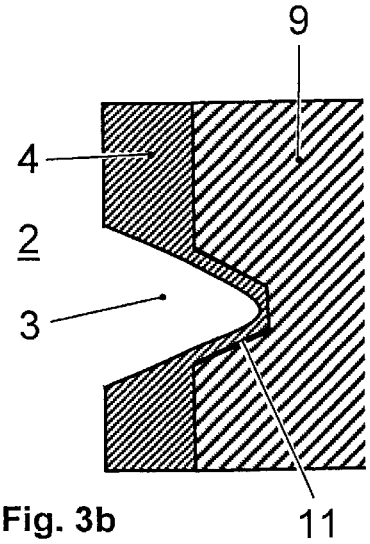
Fig. 3b
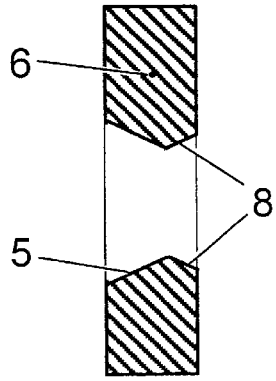
Fig. 4b
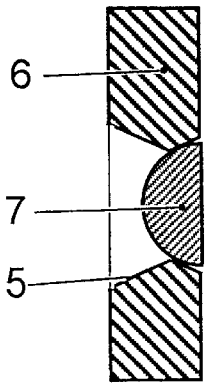
Fig. 5a
Fig. 5b
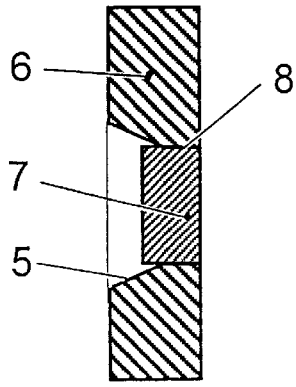

METHOD FOR PRODUCING A CAST PART, MODEL MOLD, AND CERAMIC INSERT FOR USE IN THIS METHOD

FIELD OF THE INVENTION

The invention relates to a method for producing a cast part of a thermal turbo-machine. More particularly, the invention relates to a method for producing a cast part with recesses created by projection on a ceramic insert, and to a metal mold with a ceramic insert and a ceramic insert having such projections.

BACKGROUND OF THE INVENTION

Cast parts of thermal turbo-machines are produced using known casting processes. Casting furnaces for such casting processes are disclosed, for example, in EP-A1-749 790, U.S. Pat. Nos. 3,763,926 or 3,690,367.

A method for producing a complex part of a gas turbine using a casting mold is known, for example, from U.S. Pat. No. 5,296,308. A wax model of the hollow part to be cast is produced with a model mold and a ceramic insert. After this, this model mold is removed, and a ceramic casting mold is formed around the wax model with a slip. Once the wax has been burned away, the cast part can be produced using one of the above-mentioned casting processes. It is suggested in U.S. Pat. No. 5,296,308 to provide projections on the ceramic insert. On the one hand, this is supposed to ensure that the wall thickness of the part to be poured is within a certain tolerance range. On the other hand, it makes it possible to ensure the fixation of the ceramic insert in the casting mold during the casting process. The use of these projections for the mentioned purposes was generally found to be advantageous.

However, the projections also have side effects that are not very advantageous. In the wall of the casting part, recesses are created by these projections. So far, the notch factor of these recesses has been relatively large. The disadvantage is that these recesses therefore can only be positioned in certain areas on the component surface, since tensions acting during operation on the component could potentially be too large, possibly creating tears in the affected components.

SUMMARY OF THE INVENTION

The invention is based on the objective of creating a method for producing a cast part of a thermal turbo-machine using a known casting process, wherein the casting mold of the cast part is produced with a wax model and a ceramic insert, and whereby projections are provided on the insert, which reduces the notch factor at the recesses of the cast part that are created by the projections of the insert. A further objective is to create a model mold and a ceramic insert for this method.

According to the invention, this objective is realized with a method for producing a cast part in that on the cast part, recesses are created by the projections of the ceramic insert, whereby the projections have an angle between the center line and outer edge of the projections of less than 30°. The objective is furthermore realized with a model mold comprising a ceramic insert having a plurality of projections and positioned in a wax model during a casting process, and a ceramic insert comprising at least one projection on a surface. The projections have an angle between the center line and outer edge of the projections of less than 30°.

This advantageously reduces the notch factor of the recesses created on the cast part. The notch factor is reduced even further if the angle between the center line and outer edge of the projections is less than 15°. The projections can be positioned at places of the cast part where this was not previously possible because of increased tensions during operation. A higher density of the projections can be achieved. An improved distribution or increased number of projections improves the fixation of the ceramic insert in the model mold or in the ceramic casting mold during the casting process. According to another exemplary embodiment, the angles on different sides of the projection are of different sizes, i.e., have different values.

An advantageous embodiment exists if the projections project into the model mold. This, for one, achieves a clearer contour of the edges of the recess. The movement of the ceramic insert parallel to the wall of the cast part is possible to a certain extent. This can prevent a breaking of the ceramic insert through thermal tensions that act on it during the casting process. This objective is achieved better by realizing the recesses on the model mold into which the projections are projecting with a flat base.

In order to further reduce the notch factor at the recesses, it is advantageous to cut out or erode out the recesses created on the cast part because of the projections from the outer side of the cast part, in part in conical or cylindrical shape. Into the recess of the cast part, a cylindrical, conical or round pin is attached. This pin, for example, may be soldered or welded. The closing off of the recesses prevent the cooling air from exiting. Another advantage of the closure is that it prevents a local overheating of the edges of the recess. This may occur when cleaning coated blades, for example by means of arc cleaning.

BRIEF DESCRIPTION OF THE DRAWINGS

Preferred embodiments of the invention are disclosed in the following description and illustrated in the accompanying drawings in which:

FIGS. 3*a,b* show two embodiments of projections according to the invention according to the section III in FIG. 2.

FIGS. 4*a,b* shows a finished cast part, on which another recess has been provided from the outer surface.

FIGS. 5*a,b* shows the recesses created in the finished cast parts as a result of the projections according to the invention, as well as the closure of said recesses by means of pins.

Only those elements essential to the invention are shown. Identical elements in different drawings have been marked with identical reference numerals.

DETAILED DESCRIPTION OF THE INVENTION

The invention relates to a method for producing a thermally loaded cast part of a thermal turbo-machine. Specifically, this may be, for example, a guide vane or rotating blade of a gas turbine or a combustor part. These cast parts and the method according to the invention for their production are explained in more detail below in reference to the enclosed drawings.

These cast parts are produced using casting furnaces known generally from the state of the art. By using such a casting furnace, components that have complicated designs and can be exposed to high thermal and mechanical stresses can be produced. Cast parts of thermal turbo-machines as a rule are monocrystalline (SX) or directionally solidified (DS) components. However, the invention is in no way limited to these. Rather, it may also extend to non-directionally solidified components (CC; conventionally cast).

Figure 1:
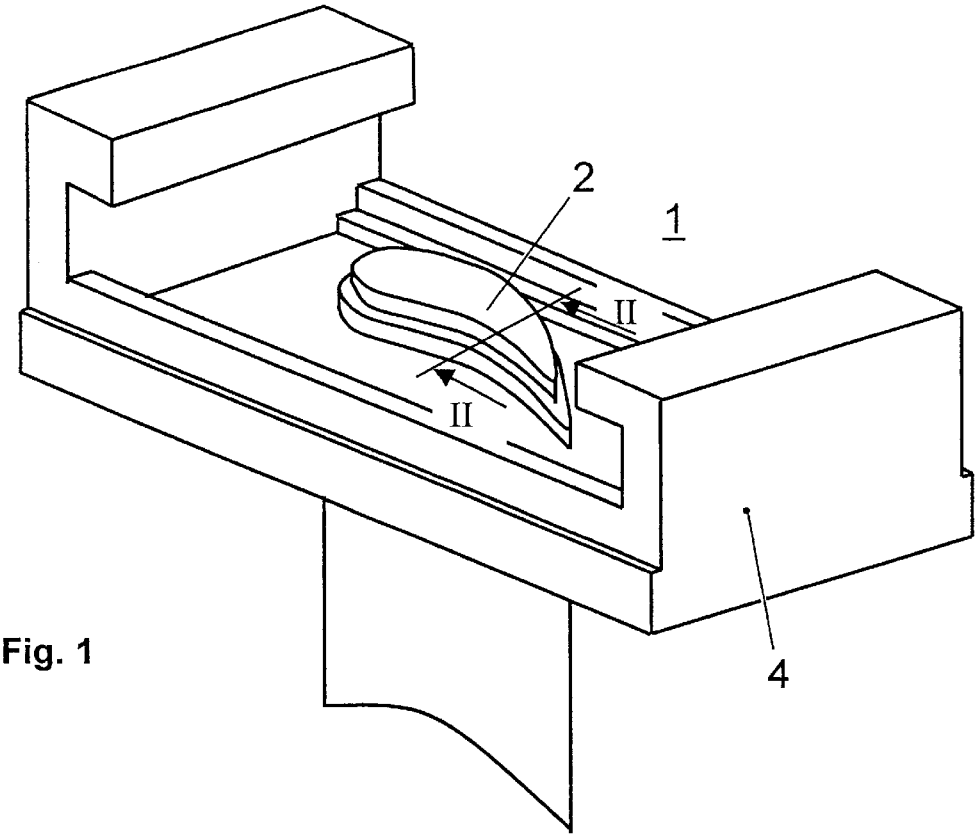
FIG. 1 shows a wax model of a turbine blade with an insert.

FIG. 1 shows a wax model 1 of a turbine blade to be cast. This wax model 1 is dipped into a liquid, ceramic material, also called a slip. Hereby the future ceramic casting mold of the cast part forms around the wax model 1. The ceramic material is then dried, creating the casting mold with which the cast part is produced. After the drying of the slip, the wax 4 is removed, i.e. burned out, by means of a suitable thermal treatment. In this process step, the casting mold is also fired, i.e. it receives its strength in this way. The cast part is produced in an actually known manner with the resulting casting mold by means of a casting furnace known from the state of the art. Later, the ceramic casting mold is removed in a suitable manner, for example by using an acid or lye.

The turbine blade produced from the wax model 1 of FIG. 1 has a cavity, into which cooling air can be fed during operation of the turbo-machine. As is illustrated in FIG. 1, a ceramic insert 2 reflecting the geometry of the cavity is located inside the wax model 1 during the production of the casting mold. This wax model 1 is produced with another model mold 9 (not shown in FIG. 1), whereby liquid wax 4 is poured between the model mold 9 and the ceramic insert 2 inside it, which liquid wax then solidifies.

Figure 2:
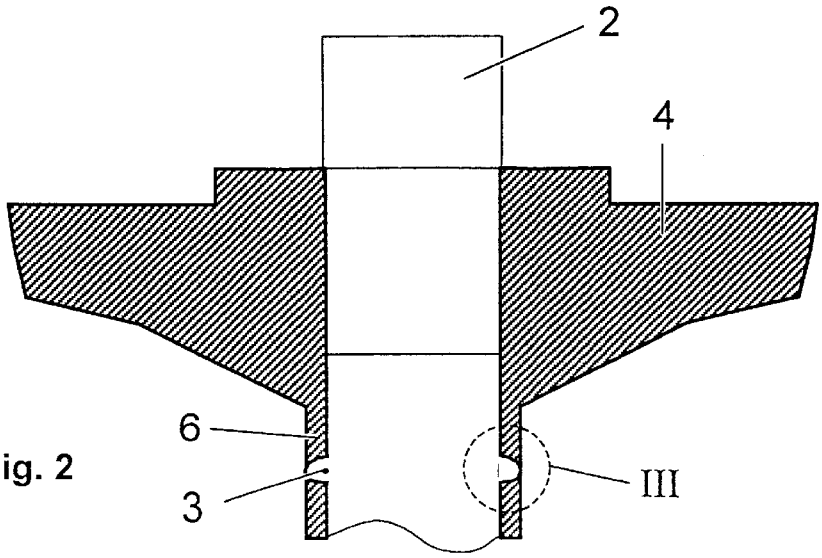
FIG. 2 shows a section according to line II—II in FIG. 1.

FIG. 2 shows a section according to line II—II of FIG. 1 through the wax model 1 and the ceramic insert 2. The ceramic insert 2 is provided with projections 3 according to the invention. The projections 3 project into the wax 4 of the wax model 1.

The projections 3 according to the invention and the recesses 5 created by them in the cast part 6 are shown in more detail in FIGS. 3, 4, and 5. As illustrated in FIG. 3*a*, it is suggested according to the invention that the projections 3 are produced with an angle α, β between a center line 10 of the projections 3 and the outer edge of the projections 3 of not more than 30°. The notch factors at the recesses 5 resulting from the projections 3 on the cast part 6 (FIGS. 4, 5) are hereby reduced in an advantageous manner. The projections (3) for example also can be positioned at places of the cast part 6 where this was previously not possible because of increased tensions during operation. A higher density of the projections 3 on the surface can also be achieved. This permits a better distribution or greater number of projections 3. As a result, the fixation of the ceramic insert 2 in the model mold 9 or in the ceramic casting mold is improved during the casting process. In an exemplary embodiment, the angle α, β between the center line and the outer edge of the projections is even smaller than 15°. This further reduces the notch factor. According to the exemplary embodiment of FIG. 3*a*, the angles α, β on different sides of the projection 3 can be of different sizes, i.e., have different values.

The embodiment in FIG. 3*b* of a projection 3 according to the invention is characterized in that the projection 3 projects beyond the surface of the wax model 1 into the beads II of the model mold 9. In an exemplary embodiment, this will be a length of approximately 1 to 2 mm. Such an arrangement is advantageous, since it results in a clear delimitation of the edges of the recess 5 on the finished cast part 6. A thin casting skin or "frayed" edges may form on the outside of the cast part 6 with a projection 3 according to FIG. 3*a*, which requires an additional finishing of the created recesses 5.

The embodiment according to FIG. 3*b* with projecting projections 3 also has the advantage that the projections 3 are visible from the outside once the model mold 9 has been removed, so that the resulting recesses 5 are easier to find. This allows for an easier and more accurate execution of the following process steps.

The already mentioned fixation of the ceramic insert 2 parallel or vertical to the wall of the cast part 6 during the casting process is improved with such an embodiment. While movement vertical to the Wall is then only limited to a very limited extent, a movement parallel to the wall is still possible to a certain extent. This results in a better control of the wall thickness of the cast part 6 and may be able to prevent a breaking of the ceramic insert 2 due to thermal tensions acting on it. Wax 4 is also filled in around the projection 3. The material created at this point in the casting process must later be removed in an additional process step. In order to enable or prevent the above-mentioned movements parallel or vertical to the wall, it is advantageous that the beads 11 on the model mold 9 are realized in the following manner: instead of creating a shape complimentary with the projections 3, a bead 11 is created, which has a flat base. This is shown in FIG. 3*b*.

Once the casting of the cast part 6 is complete, as illustrated in FIGS. 4*a, b*, a recess 8 is completely or partially cut or eroded the recesses from the outer surface of the cast part 6. This generally may be done in a cylindrical (FIG. 4*a*) or conical shape (FIG. 4*b*). The casting skin or "frayed edges" created by the embodiment in FIG. 3*a* are removed in this manner. This reduces the notch factor at the recesses 5. This recess 8 should have a depth of at least 0.1 mm. In an exemplary embodiment, a depth of 1 to 2 mm is chosen.

FIGS. 5*a,b* illustrate the additional process steps necessary for processing the recesses 5 on the finished cast part 6. The recess 8 is closed with a pin 7 that may be round, conical, or cylindrical, and may also have different lengths. The pin 7 can be soldered or welded into the casting part 6 or can be attached using another suitable process. A pin 7 may match the length of the recess 8, but may also be longer or shorter. In FIG. 5*a*, the conical recess 8 is closed with a ball. In order to avoid long welding times, this ball is welded to the contact surfaces of the recess using resistance spot welding. After this, the ball can be ground so as to be flush with the component surface, so that the remaining part fills the recess 8 as a pin 7. The closing of the recesses 8 also reduces the consumption of the cooling air, since it prevents it from flowing out.

What is claimed is:

1. Method for producing a cast part of a thermal turbo-machine, the method comprising the steps of:

producing a ceramic casting mold by means of a wax model and a ceramic insert positioned therein, wherein the wax model is produced with a model mold having the ceramic insert inside thereof, and wherein the ceramic insert has a projection located on the outside of the ceramic insert; and casting a cast part by means of the ceramic casting mold, wherein a recess is produced on the cast part during the step of casting by the projection on the ceramic insert, the projection having an angle (α, β) between the center line of the projection and a first line tangent to an outer edge of the projection of less than 30°.

2. Method as claimed in claim 1, wherein each angle is less than 15°.

3. Method as claimed in claim 1, wherein an upper angle and a lower angle are different.

4. Method as claimed in claim 1, wherein the projection projects into the model mold during the step of casting.

5. Method as claimed in claim 1, further comprising a step of removing excess material that has formed during the casting process around the projecting projection on the surface of the cast part.

6. Method as claimed in claim 1, further comprising a step of cutting out or eroding out the recess created on the cast part by the projection completely or partially in a conical or cylindrical shape from the outside of the cast part and creating a second recess therein.

7. Method as claimed in claim 6, further comprising a step of attaching a cylindrical, conical, or round pin in the second recess on the outside of the cast part to close the second recess from the outside of the cast part.

8. Method according to claim 7, wherein the step of attaching is soldering or welding.

9. The method of claim 1, wherein the ceramic insert reflects a geometry of a cavity in a part into which cooling air is fed during operation of the turbomachine, the ceramic insert having a plurality of projections on an outer surface thereof.

10. Method of claim 6, wherein a second line tangent to an outer edge, of the second recess intersects at an oblique angle a peripheral surface of the recess produced on the cast part during the step of casting.

11. Method of claim 1, wherein the projection maintains a wall thickness tolerance of the cast part.

* * * * *